United States Patent [19]

Des Lauriers

[11] 4,245,599

[45] Jan. 20, 1981

[54] VEHICLE ENGINE IDLE SPEED GOVERNOR WITH UNSYMMETRIC CORRECTION RATES

[75] Inventor: Edwin D. Des Lauriers, Kokomo, Ind.

[73] Assignee: General Motors Corporation, Detroit, Mich.

[21] Appl. No.: 105,371

[22] Filed: Dec. 19, 1979

Related U.S. Application Data

[63] Continuation-in-part of Ser. No. 953,857, Oct. 23, 1978, abandoned.

[51] Int. Cl.[3] ..... F02D 11/10

[52] U.S. Cl. ..... 123/353; 180/178; 123/361

[58] Field of Search ..... 123/102, 119 F; 180/105 E; 60/39.28 R, 39.28 P, 39.28 T; 328/69

[56] References Cited

U.S. PATENT DOCUMENTS

| | | | |
|---|---|---|---|
| 3,017,749 | 1/1962 | Heppler et al. | 60/39.28 |
| 3,184,686 | 5/1965 | Stanton | 318/69 |
| 3,700,996 | 10/1972 | Gutting | 123/102 |
| 3,809,034 | 5/1974 | Durichen | 123/102 |
| 3,869,019 | 3/1975 | Cardani | 123/102 |
| 3,885,644 | 5/1975 | Seidler et al. | 123/102 |
| 3,895,684 | 7/1975 | Takeshi et al. | 123/102 |
| 3,964,457 | 6/1976 | Coscia | 123/119 F |
| 3,998,191 | 12/1976 | Beyerlein et al. | 123/102 |
| 4,084,559 | 4/1978 | Wallbaum | 123/102 |
| 4,098,242 | 7/1978 | Anderson | 123/102 |
| 4,155,419 | 5/1979 | Mann | 123/102 |

*Primary Examiner*—Charles J. Myhre
*Assistant Examiner*—Raymond A. Nelli
*Attorney, Agent, or Firm*—R. M Sigler

[57] ABSTRACT

A vehicle engine has a throttle stop positionable in response to an actuator command signal to determine engine idle speed. Apparatus is provided to generate a speed error signal having both an absolute value and a further characteristic indicative of high or low speed; and further apparatus is provided including a memory effective to store actuator command signals corresponding to specific speed error signals and speed correction apparatus effective to obtain an actuator command signal from the memory corresponding to each speed error signal and supply the actuator command signal to the throttle stop positioning apparatus to correct engine idle speed in the direction of a predetermined desired engine idle speed. The actuator command signals corresponding to at least the largest low speed error signals have absolute values effective to produce a greater throttle stop movement than the actuator command signals corresponding to the high speed error signals of the same absolute value, so that the control responds at a faster rate to large low speed errors than to equivalently large high speed errors.

3 Claims, 5 Drawing Figures

| SPEED ERROR SIGNAL | ACTUATOR COMMAND SIGNAL |
|---|---|
| -20 | 65 |
| -16 | 50 |
| -12 | 24 |
| -8 | 20 |
| -4 | 15 |
| 0 | 0 |
| +4 | 15 |
| +8 | 19 |
| +12 | 22 |
| +16 | 40 |
| +20 | 55 |

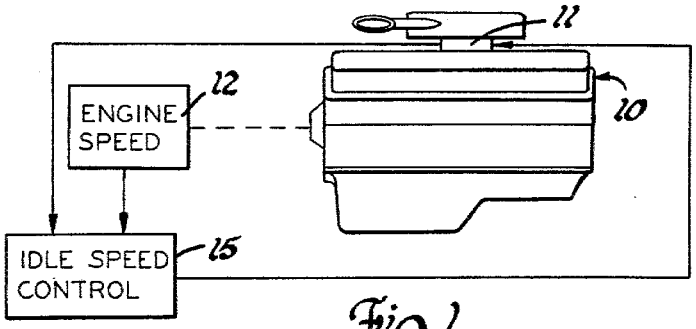
Fig.1
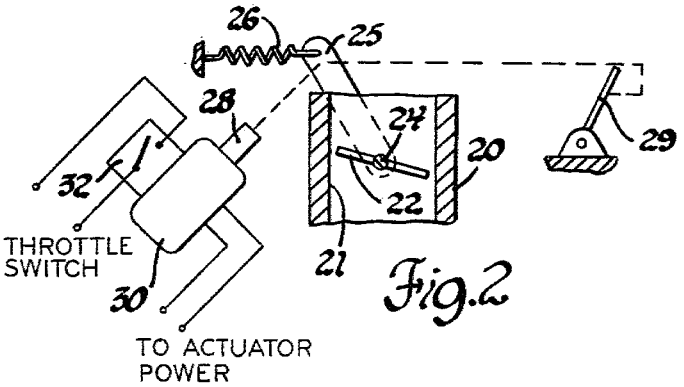
Fig.2
| SPEED ERROR SIGNAL | ACTUATOR COMMAND SIGNAL |
|---|---|
| -20 | 65 |
| -16 | 50 |
| -12 | 24 |
| -8 | 20 |
| -4 | 15 |
| 0 | 0 |
| +4 | 15 |
| +8 | 19 |
| +12 | 22 |
| +16 | 40 |
| +20 | 55 |
Fig.5
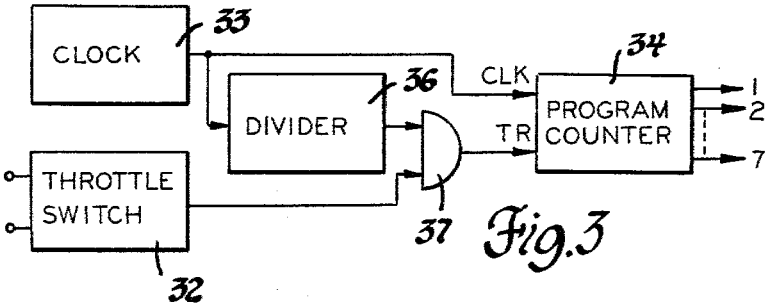
Fig.3
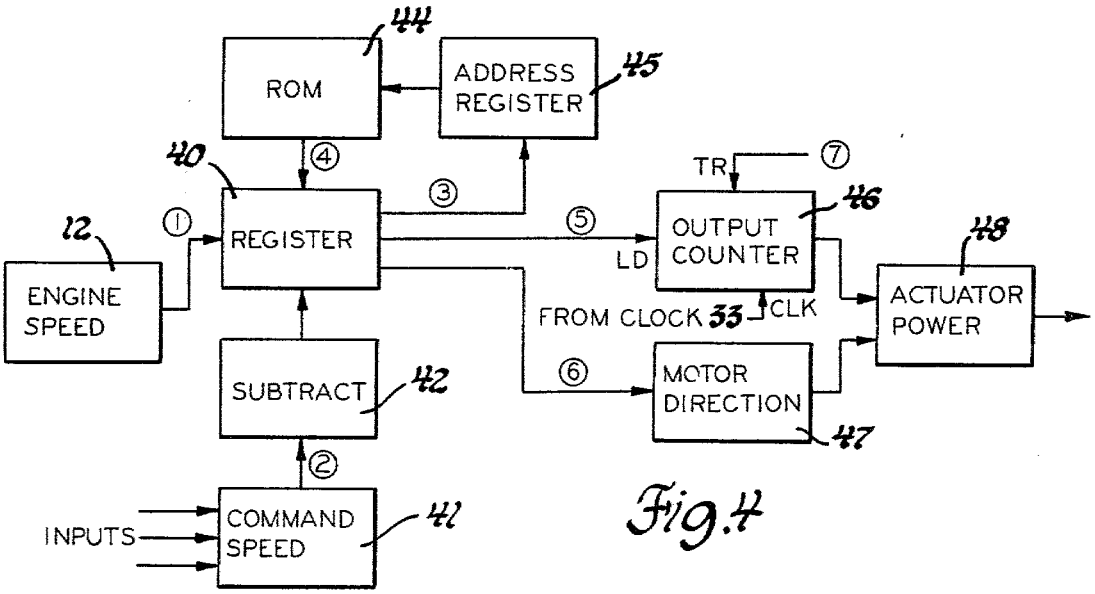
Fig.4

VEHICLE ENGINE IDLE SPEED GOVERNOR WITH UNSYMMETRIC CORRECTION RATES

BACKGROUND OF THE INVENTION

This application is a continuation-in-part of application Ser. No. 953,857, filed Oct. 23, 1978, now abandoned.

This invention relates to idle speed control systems for motor vehicles and particularly those having a closed loop on engine idle speed. Systems of this type help provide the accurate control of engine operation necessary to achieve the most stringent vehicle emissions and fuel economy goals.

A number of characteristics of such closed loop idle speed control systems may combine to create a problem in engine operation. An operating motor vehicle engine is characterized by a maximum speed of response to any attempt to change its engine speed. Electrical speed control apparatus is capable of responding to a speed error and moving a throttle stop for a predetermined distance in a direction to correct the error at a rate significantly faster than the engine can respond to the new position of the throttle stop. This may tend to cause overshoot in the response of the system to idle speed errors if the response of the control apparatus is not compensated in some manner.

Another characteristic of a motor vehicle engine idle speed control apparatus is the fact that such apparatus attempts to maintain vehicle engine speed at or very near the lowest speed at which the engine will operate. This characteristic differentiates idle speed control systems from all other vehicle or vehicle engine control systems. In view of this characteristic, the speed of engine operation at idle must not be allowed to fall very far below the predetermined idle speed or to remain below said predetermined idle speed for any appreciable length of time, in order that the engine does not stall. It may be desirable, consequently, to have an unsymmetrical response to engine idle speed errors: that is, the control system may respond very quickly to a low idle speed error situation in order to get engine speed up before the engine stalls but respond more slowly or in lesser degree to a high speed error situation so that overshoot does not carry the engine into a low idle speed situation where stall may occur.

SUMMARY OF THE INVENTION

It is, therefore, an object of this invention to provide an improved closed loop control system effective to maintain the vehicle engine idle speed substantially at a predetermined idle speed with a reduced tendency toward engine stall.

It is a further object of this invention to provide a closed loop vehicle engine idle speed control apparatus which, at least for large speed errors, has a greater response to a low speed error and a smaller response to a high speed error in order to prevent engine stall.

In particular, this invention provides apparatus including a throttle stop, actuator means effective to position the throttle stop in response to actuator command signals, apparatus effective to generate speed error signals, a memory effective to store predetermined actuator command signals corresponding to individual high and low speed error signals and apparatus effective to obtain, from the memory, actuator command signals corresponding to the generated speed error signals and supply the actuator command signals to the actuator apparatus in closed loop operation to maintain vehicle engine idle speed substantially at a predetermined reference. The actuator command signals in the memory corresponding to at least the largest low speed error signals have values effective to produce a greater throttle stop movement than the actuator command signals corresponding to the high speed error signals of the same absolute value.

Further details and advantages of this invention will be apparent from the accompanying drawings and following description of a preferred embodiment.

SUMMARY OF THE DRAWINGS

FIG. 1 shows a vehicle engine with an idle speed control according to this invention.

FIG. 2 shows a portion of the air and fuel induction apparatus for the engine of FIG. 1.

FIG. 3 is a block diagram showing timing apparatus for the idle speed control used with the engine of FIG. 1.

FIG. 4 shows an idle speed control for use with the engine of FIG. 1.

FIG. 5 is a sample, in tabular form, of certain actuator command signals corresponding to specific speed error signals as stored in the memory apparatus of the idle speed control of FIG. 4.

DESCRIPTION OF THE PREFERRED EMBODIMENT

Referring to FIG. 1, a vehicle engine 10 includes air and fuel induction apparatus 11 and a standard crankshaft, not shown, which is characterized, during engine operation, by a rotational speed which is commonly termed engine speed. The apparatus of FIG. 1 further includes engine speed measuring apparatus 12, which is adapted to measure said engine speed and generate a signal indicative thereof to an idle speed control 15, which is adapted to control the idle speed of engine 10.

FIG. 2 shows a portion of the air and fuel induction control system 11 of engine 10 in greater detail. A throttle body housing 20 defines an induction throat 21 which includes a rotatable throttle blade 22 effective to control the flow of air therethrough. Throttle blade 22 is mounted on a throttle shaft 24 which has rigidly attached thereto a link 25 effective to control the angular position of throttle blade 22 within throat 21. Link 25 is normally biased by a spring 26 in the direction of a throttle stop 28 but is adapted to be pulled away from said throttle stop 28 by linkage, not shown, in response to movement of a throttle pedal 29. Additional apparatus, not shown, adds fuel to the air inducted through induction throat 21 in predetermined proportion so that the position of throttle blade 22 partly determines the idle speed of engine 10 when link 25 abuts the throttle stop 28. The air and fuel induction apparatus may comprise a carburetor, throttle body injection apparatus or port injection apparatus of any known type that conforms with the above description. Throttle stop 28 is movable and attached to a throttle stop actuator 30 which is a pulsed motor with a linear output. Actuator 30 is effective to move throttle stop 28 in either one of two directions to open or close throttle blade 22 while electric power is supplied to said actuator and to hold throttle stop 28 in a fixed position when power is not so supplied. Many such motors are known to those skilled in the art of automatic control systems. The polarity of the power so supplied can determine the direction of throttle stop movement and the length of time in which said power is supplied can determine the length of throttle stop movement.

Actuator 30 further includes a throttle switch 32 which is mechanically closed by the force of link 25 against throttle stop 28. Throttle switch 32 may be physically mounted on the tip of throttle stop 28 as a contact switch or may be mechanically contained within the main body of actuator 30; and it functions to generate a signal by closing when link 25 contacts throttle stop 28 and thus when the engine 10 is in an idle condition.

FIG. 3 shows timing apparatus for the idle speed control 15 of FIG. 1. The timing apparatus comprises a clock 33 which produces constant time pulses at a very fast rate to the clock input of a program counter 34. The pulses from clock 33 are further provided to a divider 36 which reduces the frequency of clock 33 to a much lower frequency and supplies pulses at the lower frequency to one input of an AND gate 37. The other input of AND gate 37 receives the signal from throttle switch 32 indicating an engine idle condition; and the output of AND gate 37 is connected to the trigger input of program counter 34.

In operation, when throttle switch 32 is closed due to an engine idle condition, AND gate 37 is enabled to pass the pulses from divider 36 to repetitively trigger program counter 34 to count clock pulses from clock 33 and generate output pulses in time with said clock pulses consecutively on a plurality of output lines numbered 1–7 in FIG. 3. When throttle switch 32 is open, AND gate 37 is disabled and program counter 34 is not so triggered.

FIG. 4 shows a block diagram of the idle speed control 15, which is controlled by the timing apparatus of FIG. 3. Engine speed measuring apparatus 12, which may include analog to digital converting means, is connected to provide a binary digital number indicative of sampled engine speed to a register 40 upon the receipt of a pulse on output line 1 of program counter 34. Command speed apparatus 41 provides, upon the receipt of a pulse on output line 2 of program counter 34, a binary digital number representative of a desired engine idle speed through subtract apparatus 42 to register 40, with the result that the number from command speed apparatus 41 is subtracted from the engine speed number already in register 40 and the result is a speed error signal stored in register 40. In the simplest case, command speed apparatus 41 could provide a single constant number representing a constant desired engine idle speed. However, command speed apparatus 41 may also be provided with one or more environmental or engine operating condition inputs and include computing and/or memory table lookup means for generating a number representing a desired engine idle speed which varies with engine operating or environmental conditions.

The idle speed control 15 includes a memory which can be a read only memory or ROM 44 and further includes a memory address register 45. Register 40 is connected to provide its contents to address register 45 upon the receipt of a pulse on output line 3 of program counter 34. This contents is a binary digital number with a sign bit which represents a speed error signal having an absolute value determined by all the bits of the number except the sign bit and a characteristic indicative of high or low speed represented by the sign bit. Address register 45 is connected to designate a particular address in ROM 44; and ROM 44 is connected to register 40 to provide the contents of the address indicated in address register 45 upon the receipt of a pulse on output line 4 of program counter 34. The contents of this memory location in ROM 44 comprises an actuator command number comprising a plurality of bits indicating a length of time for power to be applied to actuator 30 and at least one additional bit indicating a motor direction or polarity of applied power.

Idle speed control 15 further includes an output counter 46, a motor direction register 47 and an actuator power driver 48. Register 40 is connected to provide its contents less the sign bit to the load input of output counter 46 upon the receipt of a pulse from output line 5 of program counter 34. Register 40 is further adapted to provide its sign bit to motor direction register 47 upon the receipt of a pulse from output line 6 of program counter 34. Motor direction register 47 serves as a flat register to control the polarity or direction of power supplied by actuator power and driver 48 to actuator 30. Output counter 46 is adapted to control the beginning and end of the actual application of power from actuator power driver 48 to actuator 30, beginning with a trigger input pulse from output line 7 of program counter 34. Output counter 46 is a down counter which counts clock pulses from clock 33 and terminates actuator power driver 48 when that count reaches 0.

FIG. 5 shows, in tabular form, selected absolute values of the actuator command numbers, stored in ROM 44, which numbers determine the correction pulse width for actuator power, and identifies the corresponding positive and negative speed error numbers which serve as addresses for ROM 44. The negative speed error numbers correspond to speeds less than the predetermined idle speed; while the positive speed error numbers correspond to speeds greater than the predetermined idle speed. It can be seen that, although for positive or negative absolute speed error numbers of 4 of the actuator command number is 15, for greater absolute speed error numbers the actuator command number becomes greater for negative speed errors than for positive speed errors. This will result in a longer power pulse to the actuator for negative speed errors in accordance with the objects of the invention.

Although there are many embodiments of this invention that will occur to those skilled in the art of engine idle speed control, this invention was reduced to practice using a digital microcomputer with a stored program which converted the hardware into the equivalent of the apparatus shown in FIGS. 3 and 4. The apparatus in these Figures is simplified for convenience, but those familiar with digital computing apparatus will recognize the elements and could easily program any particular digital microcomputer to create the equivalent apparatus. Therefore, this invention should be limited only by the claims which follow.

The embodiments of the invention in which an exclusive property or privilege is claimed are defined as follows:

1. In a vehicle engine having fuel induction and control means including a throttle for controlling the air flow rate to the engine and a throttle stop for determining the engine idle throttle position, engine idle speed governing apparatus comprising:

actuator means effective to position the throttle stop in response to an actuator command signal, said actuator means being capable of movement, at least in the direction of decreasing engine speed, at a faster rate than the engine itself can decrease its speed;

means effective to generate a speed error signal having an absolute value proportional to the difference between engine speed and a predetermined reference and a further characteristic indicative of high or low speed, respectively, for speeds greater than the reference or speeds less than the reference;

memory means effective to store predetermined actuator command signals corresponding to individual high and low speed error signals, the actuator command signals corresponding to at least the largest low speed error signals having values effective to produce a greater throttle stop movement than the actuator command signals corresponding to the high speed error signals of the same absolute value;

means effective to obtain from the memory means the actuator command signal corresponding to the speed error signal and to provide the actuator command signal to the actuator means to generate a throttle stop movement to return engine idle speed toward the reference by an amount determined at least in part by the value of the actuator command signal, whereby at least large corrective throttle stop movement is smaller in the correction of high engine idle speed than in the correction of low engine idle speed to prevent excessive overshoot while decreasing engine speed with the consequent possibility of engine stall.

2. In a vehicle engine having fuel induction and control means including valve means effective to control the flow of air to the engine, engine idle speed governing apparatus comprising:

actuator means effective to position the valve means in response to an actuator command signal;

means effective to generate a speed error signal having an absolute value proportional to the difference between engine speed and a predetermined reference and a further characteristic indicative of high or low speed, respectively, for speeds greater or less than the reference;

memory means effective to store predetermined actuator command signals corresponding to individual high and low speed error signals, the actuator command signals corresponding to at least the largest low speed error signals having values effective to produce a greater movement of the valve means than the actuator command signals corresponding to the high speed error signals of the same absolute value; and means effective to obtain from the memory means the actuator command signal corresponding to the speed error signal and to provide the actuator command signal to the actuator means to generate a movement of the valve means to return engine idle speed toward the reference by an amount determined at least in part by the value of the actuator command signal, whereby at least large corrective movements of the valve means are smaller in the correction of high engine idle speed than in the correction of low engine idle speed to reduce the tendency of engine stall during idle.

3. An idle speed control system for an internal combustion engine for maintaining its idle speed at a predetermined value comprising:

movable air flow control means for varying the flow of air into the engine and thereby its output speed;

an electrical bidirectional actuator coupled to said air flow control means for moving it in opposite directions to thereby control the amount of air flow to the engine, said actuator moving said movable means by amounts corresponding to the duration of electrical energization of the actuator;

means for sensing engine speed;

means providing a reference signal indicative of a desired engine speed;

means for developing an error signal which is a function of the deviation of actual engine speed from desired engine speed;

electrical pulse generator means responsive to the magnitude of said deviation to provide output electrical energizing pulses to said actuator wherein the durations of said pulses are a function of the magnitude of the deviation and wherein greater durations are provided for a given speed deviation, at least for large deviations, when the engine is operating below said reference speed; and, means responsive to the sense of said error signal for controlling the direction of movement of said air flow control means such as to move said air flow control means in a direction to increase the flow of air into the engine when engine speed is below said reference speed and to move the air flow control means in an opposite direction to thereby reduce air flow to the engine when engine speed is above said reference value.

* * * * *